US006460189B1

(12) United States Patent
Welch

(10) Patent No.: US 6,460,189 B1
(45) Date of Patent: Oct. 8, 2002

(54) PRE-KNOTTED NECKTIE CLASP ASSEMBLY

(76) Inventor: Ryan Scott Welch, P.O. Box 623, Buffalo, TX (US) 75831

( * ) Notice: Subject to any disclaimer, the term of this patent is extended or adjusted under 35 U.S.C. 154(b) by 0 days.

(21) Appl. No.: 09/843,980

(22) Filed: Apr. 27, 2001

(51) Int. Cl.[7] ..... A41D 25/02
(52) U.S. Cl. ..... 2/145; 24/49.1
(58) Field of Search ..... 2/144–151, 152.1, 2/153–157; 24/49.1, 57, 59, 62

(56) References Cited

U.S. PATENT DOCUMENTS 2,023,293 A 12/1935 Sears
2,269,017 A * 1/1942 Gladstone ..... 2/153
3,346,881 A 10/1967 Mathison
3,745,614 A * 7/1973 Tsang ..... 2/148
3,872,513 A 3/1975 Beaudin, Jr.
3,964,105 A * 6/1976 Gideon ..... 24/49.1
4,024,585 A * 5/1977 Girdler ..... 2/153
4,173,792 A 11/1979 Intengan
4,337,539 A * 7/1982 Najarian ..... 2/150
4,777,665 A 10/1988 Akamatsu
4,856,115 A 8/1989 Knapp
5,216,757 A * 6/1993 Dorkin ..... 2/144
5,235,704 A 8/1993 Collins

* cited by examiner

*Primary Examiner*—Gloria M. Hale
*Assistant Examiner*—Tejash Patel
(74) *Attorney, Agent, or Firm*—Mary J. Gaskin

(57) ABSTRACT

A necktie with a pre-tied knot which appears to have been hand-tied. The necktie has a body, a pre-tied knot, and a neckband-tail. The neckband is wrapped around the neck and the free portion is fixed behind the knot with a hinged two-part clasp. The tail is then tucked behind the body.

12 Claims, 4 Drawing Sheets

PRE-KNOTTED NECKTIE CLASP ASSEMBLY

BACKGROUND OF THE INVENTION

The invention herein described relates to a clasp for creating the appearance of a manually-tied necktie.

Pre-tied neckties are not new. Numerous examples of such ties have been used. Some of the neckties have no neckband; the "neck" tie is simply clamped onto the front neckband of a buttoned shirt. However, these "slip-on" ties are unattractive and tend to sag toward the neck. Other pre-tied neckties have a knotted portion with a neckband in two parts, which are linked together about the neck, using various fasteners. However, the neckband may be larger (or shorter) than the circumference of the neck portion of the shirt, causing the necktie to be too loose or too tight. Further, the connectors may be difficult to use and may show under the collar.

SUMMARY OF THE INVENTION

The present invention provides a necktie which appears to have been hand tied, but which is easily worn and removed. The necktie disclosed has a head (body), a pre-tied knot, and a neckband-tail portion. The neckband is wrapped around the wearer's neck and then fixed behind the knot with the clasp disclosed herein. The clasp, attached to the base of the pre-tied knot, consists of two sections, which are hinged along one side of each section, for opening and closing the clasp. The two sections enclose the free end of the tail and are fastened in a closed position with a catch. The remainder of the tail is tucked behind the head (body) of the tie and held there by a tie clip, a loop, or other similar means.

The clasp holds the pre-knotted necktie in place so that the necktie appears to have been manually tied. The necktie of the present invention is easily adjusted for fit around any size neck. The tie can be made in a variety of different lengths to fit each individual wearer.

It is an object of the present invention to provide a pre-knotted necktie which appears to have been manually tied.

A further object of the present invention is to provide a tie which can be adjusted both for fit around the neck and sized for length.

Still another object of the present invention is to provide a pre-knotted necktie with a hidden clasp which can be easily opened and closed.

DESCRIPTION OF THE PREFERRED EMBODIMENT

Figure 1:
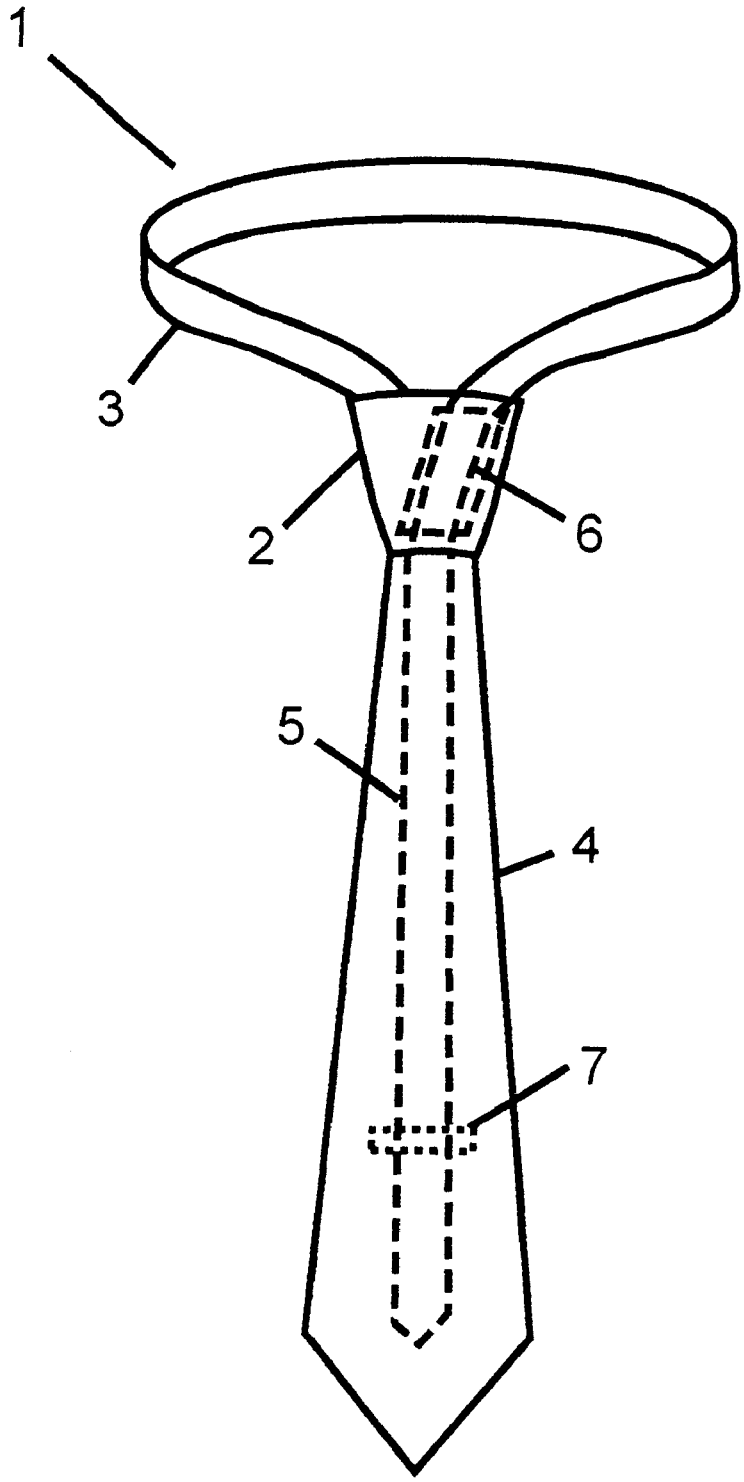
FIG. 1 is a see-through front view of the tie of the present invention showing the position of the clasp and the tail of the necktie behind the pre-formed knot and the head (body) of the tie.

As shown in FIG. 1, the pre-knotted necktie and clasp combination 1 of the present invention comprises a pre-formed knot 2, a neckband portion 3, a head portion 4, a tail portion 5 and a clasp 6. The pre-formed knot 2 shown is a Windsor knot, but various other styles can be pre-formed. One end of the neckband 3 is attached to the pre-formed knot 2. The other end of the neckband 3 is held by the clasp 6. The tail 5 can be held in place by an optional loop 7.

Figure 2A:
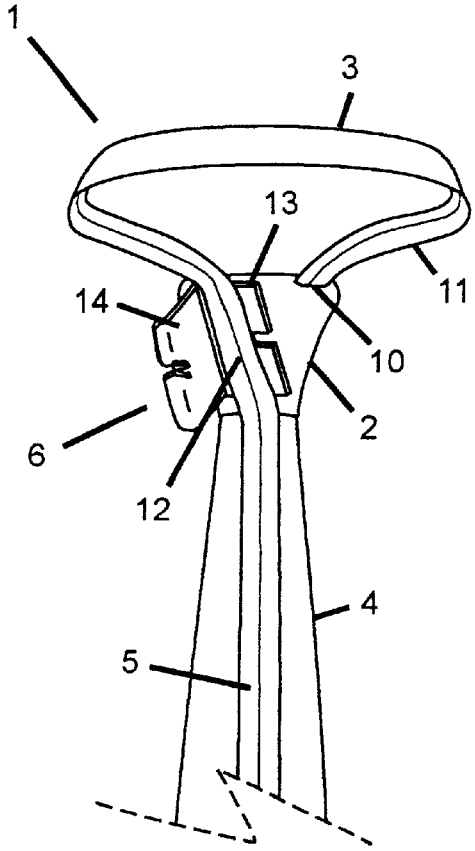
FIG. 2*a* is a back view of a portion of the tie, showing the clasp attached to the back of the knot, in an open position.
Figure 2B:
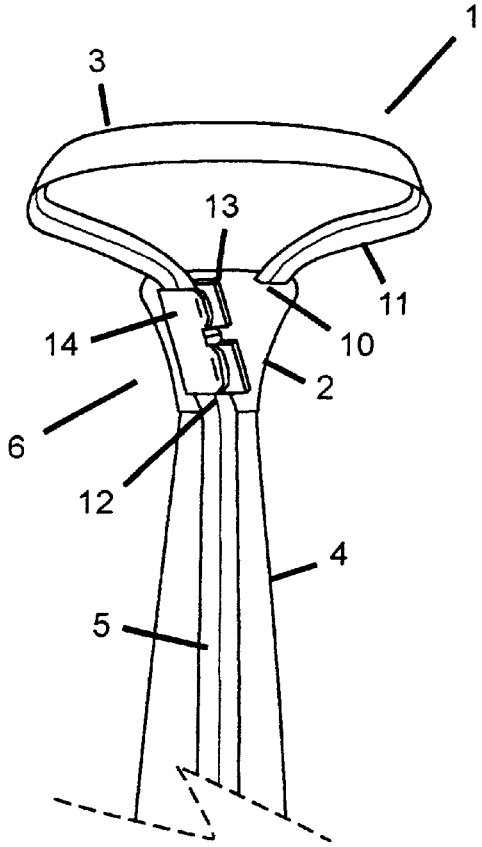
FIG. 2*b* is a back view of a portion of the tie, showing the clasp attached to the back of the knot, in a closed position.

FIG. 2*a* shows the attachment point 10 for the attached end 11 of the neckband 3. The attached end 11 is permanently attached to the preformed knot 2 by sewing or other means, but appears to be extending from a manually-tied knot. The free end 12 of the neckband 3 is placed between the back plate 13 and front plate 14 of the clasp 6. The free end 12, extends to become the tail 5, which is aligned with the head 4. In FIG. 2*b*, the front plate 14 has been closed against the back plate 13, enclosing the free end 12, which also appears to be extending from a manually-tied knot.

Figure 3:
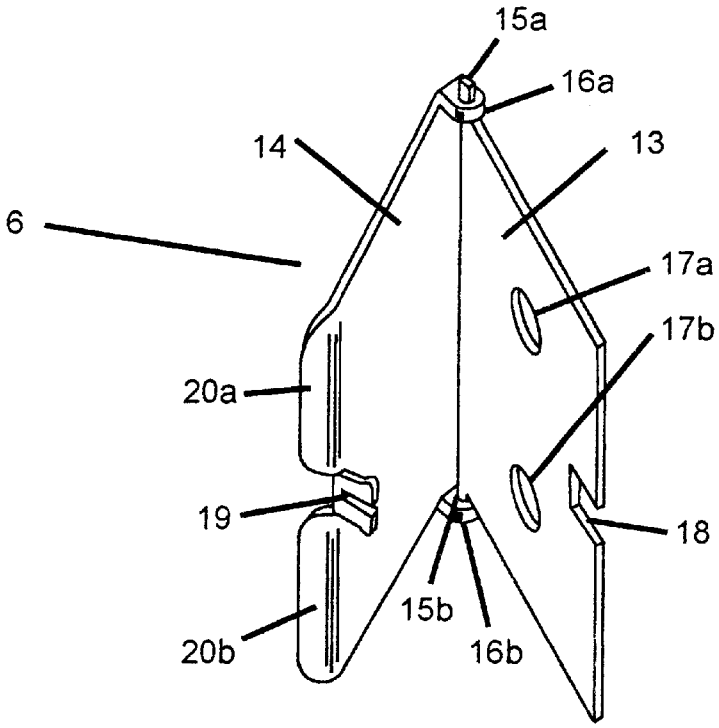
FIG. 3 is a perspective view of the clasp itself, in an open position.

FIG. 3 shows the hinged clasp 6, which is preferably formed from stainless steel. The clasp 6 generally consists of a back plate 13 and a front plate 14. Hinged posts 15*a*, 15*b* formed on an edge of the back plate 13 have been inserted into holes of brackets 16*a*, 16*b* formed on opposite ends of front plate 14, allowing the plates of the clasp 6 to move between "open" and "closed" positions. The back plate 13 has holes 17*a*, 17*b*, for attaching the clasp 6 to the back of the pre-formed knot 2. The back plate 13 also has a receiving notch 18. The front plate 14 has catch 19 formed perpendicular to the front plate 14, for insertion into the receiving notch 18. The formed space between the two "legs" of the catch 19 allows the catch to be squeezed into the receiving notch 18. The clasp 6 stays closed as a result of spring-induced friction. A user can easily open the clasp 6 by pulling on the radiused thumb sections 20*a*, 20*b* along the unhinged side of front plate 14.

Figure 4A:
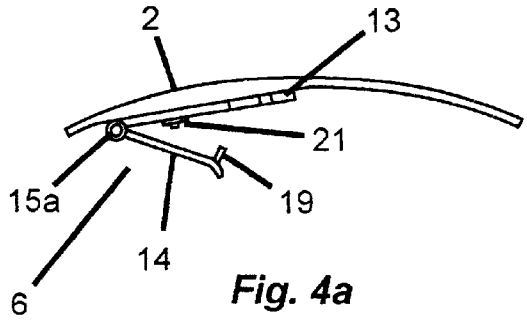
FIG. 4*a* is a top view showing the position of the clasp when attached to the back of the pre-formed knot.

In a top plan view, FIG. 4*a* shows the position of the clasp 6 after it has been attached to the back of a pre-formed knot 2 with studs 21.

Figure 4B:
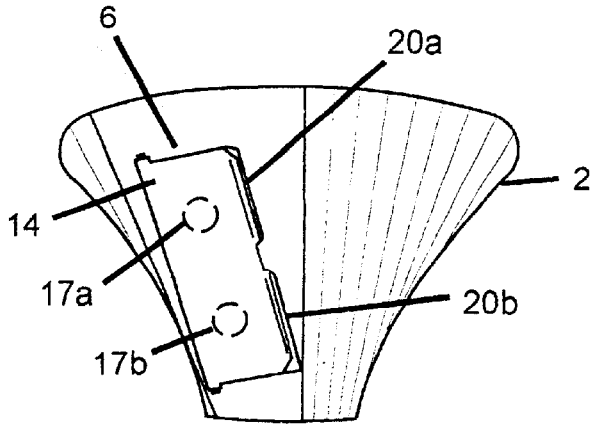
FIG. 4*b* is a back view of the clasp when attached to the back of the knot.

In a vertical plan view, FIG. 4*b* shows the position of the clasp 6 after it has been attached to the back of the pre-formed knot 2 with studs 21*a*, 21*b*.

Figure 5:
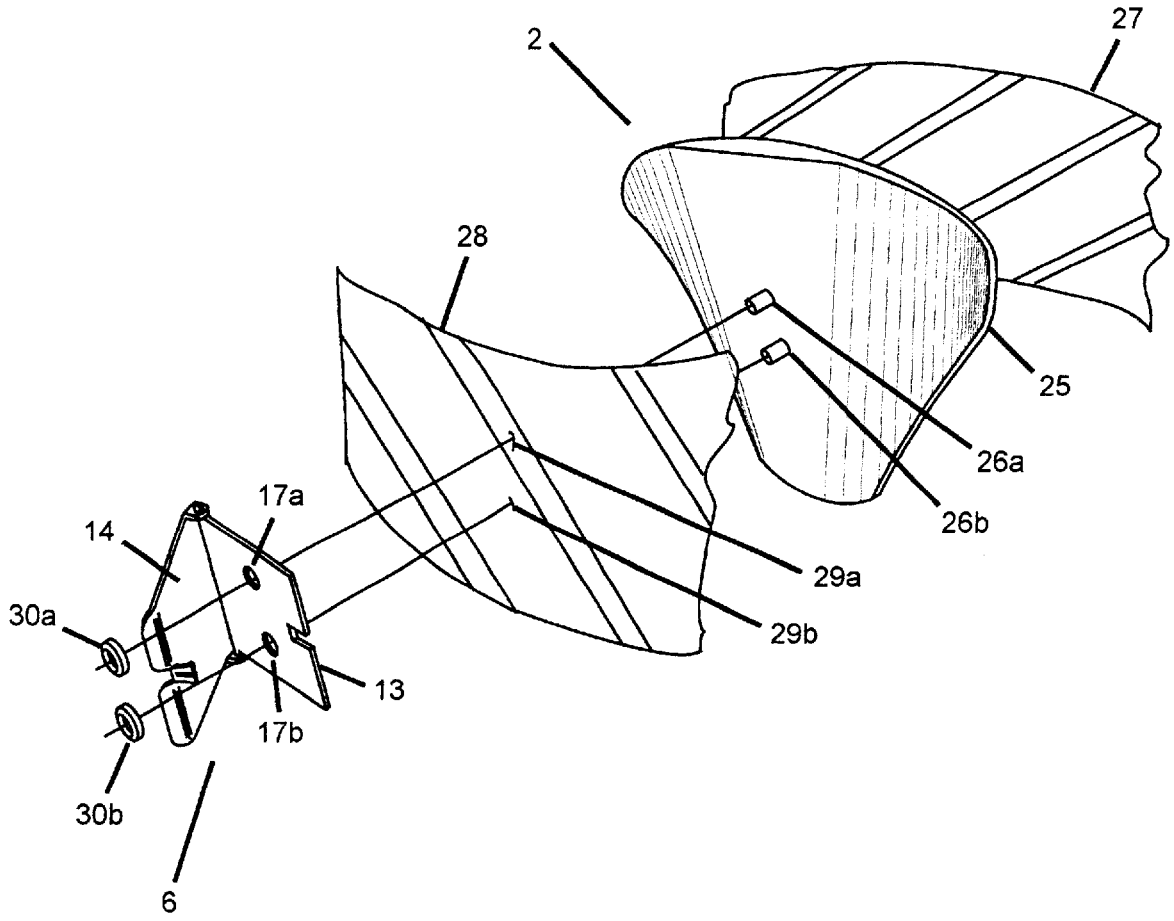
FIG. 5 is an exploded view of the knot showing how the clasp is attached to the back of the pre-formed knot.

The exploded view of FIG. 5 shows a preferred method of attaching the clasp 6 to the back of a pre-formed knot 2 of the present invention. A triangular-shaped knot body 25 has been formed from extruded plastic, with two rear-facing posts 26*a*, 26*b*. Sections of tie material 27, 28 cover the front and back of the knot body 25, to comprise the preformed knot 2. Holes 29*a*, 29*b* in back tie material 28, provide access to the posts 26*a*, 26*b*. The clasp 6 is attached to the back of pre-formed knot 2 by arranging the back plate holes 17*a*, 17*b* over the posts 26*a*, 26*b* and pressing friction nuts 30*a*, 30*b* onto the posts 26*a*, 26*b*. The clasp 6 can also be attached to the back of the pre-formed knot 2 by sewing or gluing.

What is claimed is:

1. A pre-knotted necktie combination comprising:

a length of necktie material with a front display side and a back display side and further having an enclosable end;

a simulated knot of necktie material, said knot generally shaped like an inverted three-dimensional trapezoid, said knot having an upper opening and a lower opening, and a display side and a back side;

a combination neck band and tail of necktie material having an attachable end; and a hinged clasp with a front plate and a back plate, each plate having one of two complementary elements of a fastening system for holding the clasp in a closed position with the front plate essentially parallel to the back plate;

said pre-knotted necktie combination being assembled by enclosing the enclosable end of the first length inside the lower opening of the knot, attaching the attachable end of the combination neck band and tail to the upper opening of the knot, and attaching the back plate of the clasp to the back side of the knot.

2. The pre-knotted necktie combination of claim 1 wherein the complementary elements of the fastening system consist of a catch and a receiving notch.

3. The pre-knotted necktie combination of claim 2 wherein the front plate of the clasp further has one or more radiused thumb portions extending away from the back plate.

4. The pre-knotted necktie combination of claim 3 wherein the clasp is. made from stainless steel.

5. The pre-knotted-necktie combination of claim 1 wherein the necktie material of the knot encloses a plastic knot body.

6. The pre-knotted necktie combination of claim 5 wherein the knot body has a front side and a back side, with two posts formed on the back side of the knot body, and the necktie material of the knot has two openings to provide access to the posts; and the back plate of the clasp has two openings through which the posts are inserted, the clasp being attached to the back side of the knot body by pressing friction nuts onto the posts.

7. The pre-knotted necktie combination of claim 6, wherein the fastening system of the clasp consists of as catch and a receiving notch.

8. The pre-knotted necktie combination of claim 7, wherein the front plate of the clasp further comprises one or more radiused thumb portions extending away from the back plate.

9. The pre-knotted necktie combination of claim 8, wherein the clasp is made from stainless steel.

10. A pre-knotted necktie combination for wearing around a wearers neck comprising a simulated knot of necktie material with a top side, a bottom side, and a back side having an outer surface, said knot having a hinged clasp affixed to the outer surface of the back side, a length of necktie material attached to the bottom side, and a combination neckband and tail of necktie material attached to the top side, said necktie combination being worn by holding the knot at the wearer's neck and then wrapping the neckband and tail around the wearer's neck and holding a portion of the neckband and tail in place within the clasp.

11. The pre-knotted necktie combination of claim 10 wherein the clasp has a front plate with a catch and a back plate with a receiving notch, and the neckband and tail portion is held in place by pushing the catch into the receiving notch.

12. The pre-knotted necktie combination of claim 11 wherein the front plate of the clasp further has one or more radiused thumb portions extending away from the back plate, and the clasp is opened by pulling against the radiused thumb sections until the catch is released from the receiving notch.

* * * * *